US005083704A

United States Patent [19]

Rounthwaite

[11] Patent Number: 5,083,704

[45] Date of Patent: Jan. 28, 1992

[54] TRASH DISPOSAL SYSTEM

[76] Inventor: George Rounthwaite, P.O. Box 1402, Bellingham, Wash. 98226

[21] Appl. No.: 562,826

[22] Filed: Aug. 6, 1990

[51] Int. Cl.[5] ..... B65D 91/00

[52] U.S. Cl. ..... 232/43.2; 232/44; 232/43.4; 15/314; 15/319; 209/702; 209/942; 406/19; 406/148; 406/151; 43/58; 43/61; 43/64

[58] Field of Search ..... 232/43.1, 43.4, 43.2, 232/44, 1 R; 15/310, 314, 319; 209/702, 706, 924, 942; 406/19, 20, 117, 147, 148, 151, 168; 43/58, 61, 64

[56] References Cited

U.S. PATENT DOCUMENTS

| | | | |
|---|---|---|---|
| 1,281,587 | 10/1918 | Kovachevich | 232/43.2 |
| 2,177,328 | 10/1939 | Pender | 232/44 |
| 2,558,255 | 6/1951 | Johnson et al. | 232/1 R |
| 3,076,068 | 1/1963 | Racklyeft | 15/314 |
| 3,240,000 | 3/1966 | Hayes et al. | 15/314 X |
| 4,453,286 | 6/1984 | Wieland | 15/301 X |
| 4,566,218 | 1/1986 | Kurosawa et al. | 43/60 X |
| 4,660,758 | 4/1987 | Tavel et al. | 232/43.2 |
| 4,965,959 | 10/1990 | Gagnéo | 43/58 X |
| 4,977,638 | 12/1990 | Best | 15/301 |
| 4,987,988 | 1/1991 | Messina et al. | 232/43.2 X |

*Primary Examiner*—Gary L. Smith

*Assistant Examiner*—Michael Milano

*Attorney, Agent, or Firm*—Cassidy, Vance & Tarleton

[57] ABSTRACT

An automatic trash disposal system (20) employing a trash discharge station (56) located internally of a building structure (22) and having a plurality of dedicated trash disposal ports (60P, 60M, 60G, 60NR) for receipt of different categories of recyclable trash items and/or non-recyclable trash items; a remotely located trash housing (21) exterior of the building structure (22) and housing a plurality of dedicated removable trash receptacles (36, 38, 39, 40); conduits (64P, 64M, 64G, 64NR) coupling the trash disposal ports (60P, 60M, 60G, 60NR) with respective different ones of the remotely located dedicated trash receptacles (36, 38, 39, 40); and, a blower/motor combination (68/79) for drawing a vacuum in the enclosed remotely located trash housing (21) and the conduits (64P, 64M, 64G, 64NR) for vacuum transferal of items of trash inserted into a particular one of the interior trash disposal ports (60P, 60M, 60G, 60NR) to a particular one of the remotely located dedicated trash receptacles (36, 38, 39, 40). The automatic trash disposal system (20) may be incorporated with and as part of a central vacuum system; and/or, it may be used to remove rodents (90) from within the building structure (22).

18 Claims, 8 Drawing Sheets

TRASH DISPOSAL SYSTEM

BACKGROUND OF THE INVENTION

1. Technical Field

The present invention relates generally to an automated trash disposal system; and, more particularly, to methods and apparatus for permitting trash which has been segregated by environmental categroy—e.g., recyclable and/or non-recyclable products such as paper products, glass products, aluminum products, tin products, plastic products, unused foods, and the like—to be disposed of by consumers, janitorial employees, housewives or other individuals resident in homes, apartments and the like, office employees, factory employees, and similar individuals having custody of trash that has been generated and segregated by inserting discrete pre-categorized types of trash into selected ones of a plurality of dedicated trash disposal ports located internally within a building or other structure with the thus-segregated trash then being automatically conveyed via a vacuum or other suitable fluid handling system to a remote trash pickup location wherein the discarded trash is automatically deposited in selected ones of a plurality of trash receptacles each dedicated to receive a particular category of environmentally sensitive recyclable and/or non-recyclable trash. More specifically, the present invention provides methods and apparatus which enable individuals to dispose of trash generated within a home, office, business facility or the like by categorizing each item of trash within a particular subject matter category such as paper, plastic, glass, metal, or the like, and inserting that item of trash into a dedicated trash disposal port located within the home, office, business facility or the like with the discarded trash itself then being automatically conveyed to a remote location such as a trash bin located adjacent a curbside or within an alley and defining a pickup point where the items of trash are automatically inserted into the proper one of a plurality of dedicated trash receptacles.

2. Background Art

As is well known, there has been rapidly increasing awareness and concern with regard to environmental effects relating to virtually every type of disposable consumer item, be the item made of paper, metal, wood, plastic, glass and/or other material, many of which are not biodegradable and which may be either recyclable or non-recyclable. Recently, such awareness and concerns have resulted in imposition of mandated trash handling processes and regulations generated by city, community and/or regional authorities. For example, in some cities, towns or similar communities, regulations have been implemented requiring home owners, apartment dwellers, office staff, factory employees, and/or other individuals to deposit their trash into bins which are dedicated to receive different types of trash for subsequent pickup by an authorized sanitation service. In some cases there may be only two categories of trash such, for example, as paper products and non-paper products. However, as awareness and concern over our environment grows, more and more communities are turning to greater and greater restrictions relating to trash disposal requiring segregation between biodegradable and non-biodegradable products, segregation between recyclable and non-recyclable products, or segregation between such items as, merely by way of example, paper, glass, aluminum, plastic, unused food products, etc. Of course, the more severe the trash segregation requirements of a given community, the greater the problems and inconvenience to which individuals are placed.

For example, consider a typical home environment where a wide range of trash is generated such as used paper/cardboard products, food tins, aluminum soda and/or beer cans, glass bottles, plastic containers and the like. Consider also that such an exemplary home is located within a community where trash must be segregated by the consumer prior to discarding into only four (4) categories—viz., i) glass; ii) metal; iii) plastic; and iv), all other trash items. That home owner and all residents of that home are immediately faced with one of two choices—i.e., they can: i) dispose of all of the trash into a single container located in the kitchen, garage or the like, and later segregate that trash into the necessary categories before placing it at a curbside location; or ii), maintain four (4) separate trash receptacles in the home's kitchen, utility room, garage or the like, discarding each trash item as it is generated into the proper receptacle, and later carrying the four (4) receptacles to a remotely located curbside pickup point.

As the ensuing discussion proceeds, those skilled in the art will appreciate that the term "trash" is herein used in its broadest context to include all types of items for which the consumer, homeowner or other individual has no continuing use and wishes to discard irrespective of whether the item is or is not biodegradable and/or is or is not recyclable. Thus, the term "trash" is used to embrace: i) waste paper, paperboard and cardboard products; ii) beer bottles and similar glass containers; iii) tin or aluminum cans; iv) plastic containers and wrappings; and v), all other items of trash that are typically generated in a home, business or industrial facility; as well as: vi) unused food products which are no longer deemed edible or usable; and/or vii), other matter such, for example, as mice, rats and similar rodents that tend to infest trash collection points.

The prior art is, of course, replete with a wide range of systems for handling trash. These include, merely by way of example, a wide variety of central vacuum systems such as those disclosed in U.S. Pat. Nos.: 3,048,875—Bottinelli et al [a pneumatic system employing a central vacuum-producing device coupled to a plurality of internal conduits terminating at different locations within a building structure]; 2,675,273—Sanders [a central vacuum system embodying baseboard ducts with openings through which trash can be swept]; 2,609,190—Jackson [a suction apparatus employing conduits coupled to a suction generator at one end and to a multiplicity of inlet ports located throughout the structure]; and, 969,157—Day [a central vacuum system employing a main trash conduit extending vertically through multiple levels within a building structure wherein trash can be swept into the conduit at each different level].

In recent years, such systems have been employed in hospitals to permit used hospital waste ranging from rubber gloves to disposable gowns, to syringes, to severed body parts, and the like, to be discarded by wrapping such materials at the particular ward where generated and inserting the wrapped waste into a central vacuum system which conveys the wrapped waste from the ward of generation to a single collection point.

However, none of the foregoing systems known to the present inventor are capable of differentially handling diverse types of waste materials and transporting them from the point of generation to a selected one of a plurality of dedicated waste receptacles, whether or not remotely located.

Other conventional prior art trash handling systems include those disclosed in U.S. Pat. Nos.: 4,363,674—Fullenwider [a vacuum system coupled to a stove, furnace, fireplace or the like for permitting automatic removal and discarding of ash and similar waste]; 4,049,321—Bunting [apparatus for removing waste material from a manufacturing operation by depositing the material on a screen in a box, closing the box, and blowing the material to a waste disposal point]; and, 3,885,835—Breeden [a vacuum system for permitting disposal of waste paper towels].

U.S Pat. No. 4,108,498—Bentsen is of interest for its disclosure of a plant for handling trash wherein garbage of all types is input to the system via a selected one of multiple inlet ports and inlet conduits and stored therein until each such port/conduit is coupled to a common horizontal transport duct communicating with a common trash receptacle. Trash is moved from the inlet duct into the main transport duct through a valve opening, and then to a common reservoir by means of vacuum. A somewhat similar arrangement is disclosed in U.S. Pat. No. 4,453,286—Wieland wherein the system is designed for incorporation into a commercial aircraft such that each passenger has access to a trash disposal port adjacent the passenger's seat, with all trash being conveyed via a vacuum system to a single trash receptacle.

However, none of the foregoing prior art, nor any other prior art of which the present inventor is aware, provides multiple trash disposal ports internally of a structure wherein such ports are dedicated to accept only one of different categories, of trash, with the trash inserted therein being conveyed via a vacuum or other suitable fluid system to a remote location and stored in a selected one of a comparable plurality of trash receptacles each dedicated to receive and temporarily hold different types of environmentally sensitive trash items for pickup and subsequent processing.

SUMMARY OF THE INVENTION

The present invention overcomes all of the foregoing disadvantages by providing an automated trash handling system wherein the user is provided with: i) a plurality of trash disposal ports located internally of a building structure, with each port dedicated to accept a different category of environmentally sensitive trash; ii) a remotely-located trash storage/pickup station—e.g., a station located adjacent dumpsters in an alley or at curbside—containing a comparable plurality of trash receptacles each dedicated to receive and temporarily store different categories of environmentally sensitive trash; iii) conduit means coupling the plurality of internally located trash disposal ports with respective different ones of the comparable plurality of remotely located trash receptacles; and iv), vacuum generating means or similar fluid means for automatically conveying each item of trash inserted into a given dedicated trash disposal port to the proper one of the plurality of remotely located dedicated trash receptacles for subsequent pickup and processing.

To accomplish this, the exemplary form of the invention envisions, merely by way of example, a residential trash handling system or the like wherein two (2), three (3), four (4), or more dedicated trash disposal ports are formed within a bounding structural surface of a building such, for example, as a wall in a kitchen, laundry room, utility room, garage or the like with each trash disposal port being normally closed by means of a hinged or slidable closure member. While the external portions of the trash disposal ports and closures which are visible to persons within the room can be coordinated with the room's decor so as to be essentially invisible, such ports may or may not be labeled with the type of trash for which each is dedicated—e.g., glass, paper, metal, food, etc. Alternatively, the internal portions of the discharge conduit associated with each trash disposal port and/or the interior of the closure member may be color coded to designate the particular category of trash to be deposited therein—e.g., red for glass, blue for metal, yellow for plastic, white for paper and/or other non-categorized trash, etc.—so that when the user opens the trash disposal port closure member, he/she can immediately confirm that the particular item of trash is being discarded in the proper disposal port.

At the same time, the trash handling system of the present invention envisions a remotely located trash collection point which can be at curbside (either above or below ground), in an alley, or at any other point where sanitary service employees commonly pick up trash. Again, the trash collection point would be sized to accommodate a plurality of discrete trash receptacles each adapted to be coupled to a selected different one of the plurality of internal trash disposal ports and each dedicated to receive a particular type of trash. Where the particular community has assigned color codings for trash items such as glass, metal, plastic, paper and other items, the individual trash receptacles and corresponding internal trash disposal ports could be color coded in like manner.

The remotely located trash receptacles and the internal trash disposal ports are, in the exemplary form of the invention, interconnected by conduit-defining means such that when any given trash disposal port is opened, a trash discharge path is created extending from that open port to the correct one of the remotely-located trash receptacles which has been dedicated to receive the particular category of trash being discarded. And, finally, the present invention envisions the use of a vacuum system for automatically transporting the discarded trash item from the internal trash disposal port to the remotely-located trash receptacle. Such vacuum system may take a wide variety of forms and may be energized in any desired manner. For example, the user may manually flip a switch to turn the vacuum system "ON" when an item of trash is to be discarded and "OFF" moments later when that item has been received at the proper remotely-located trash receptacle. Alternatively, the closure mechanisms at each internal dedicated trash disposal port may be interconnected with a switch such that when that closure member is opened, the vacuum system is automatically turned "ON".

A plurality of conduits may be used to couple respective different ones of the plurality of internal trash disposal ports to respective different ones of the plurality of remotely-located dedicated trash receptacles. Alternatively, a single conduit may be coupled to all internal trash disposal ports and to all dedicated trash receptacles with suitable conventional valve mechanisms being located at the plurality of remotely-located trash receptacles which are automatically opened dependent solely upon which trash disposal port is used. In either case, the trash conduit(s) can be located within walls of the structure and/or either above or below ground. Suitable seals can be provided at various points in the system such as at the remotely-located trash receptacles and/or at the closures for the internal trash disposal ports to insure that foul or noxious odors, flies and other unwanted polluntants are not permitted to enter the structure.

DESCRIPTION OF THE DRAWINGS

These and other objects and advantages of the present invention will become more readily apparent upon reading the following Detailed Description and upon reference to the attached drawings, in which.

Figure 1:
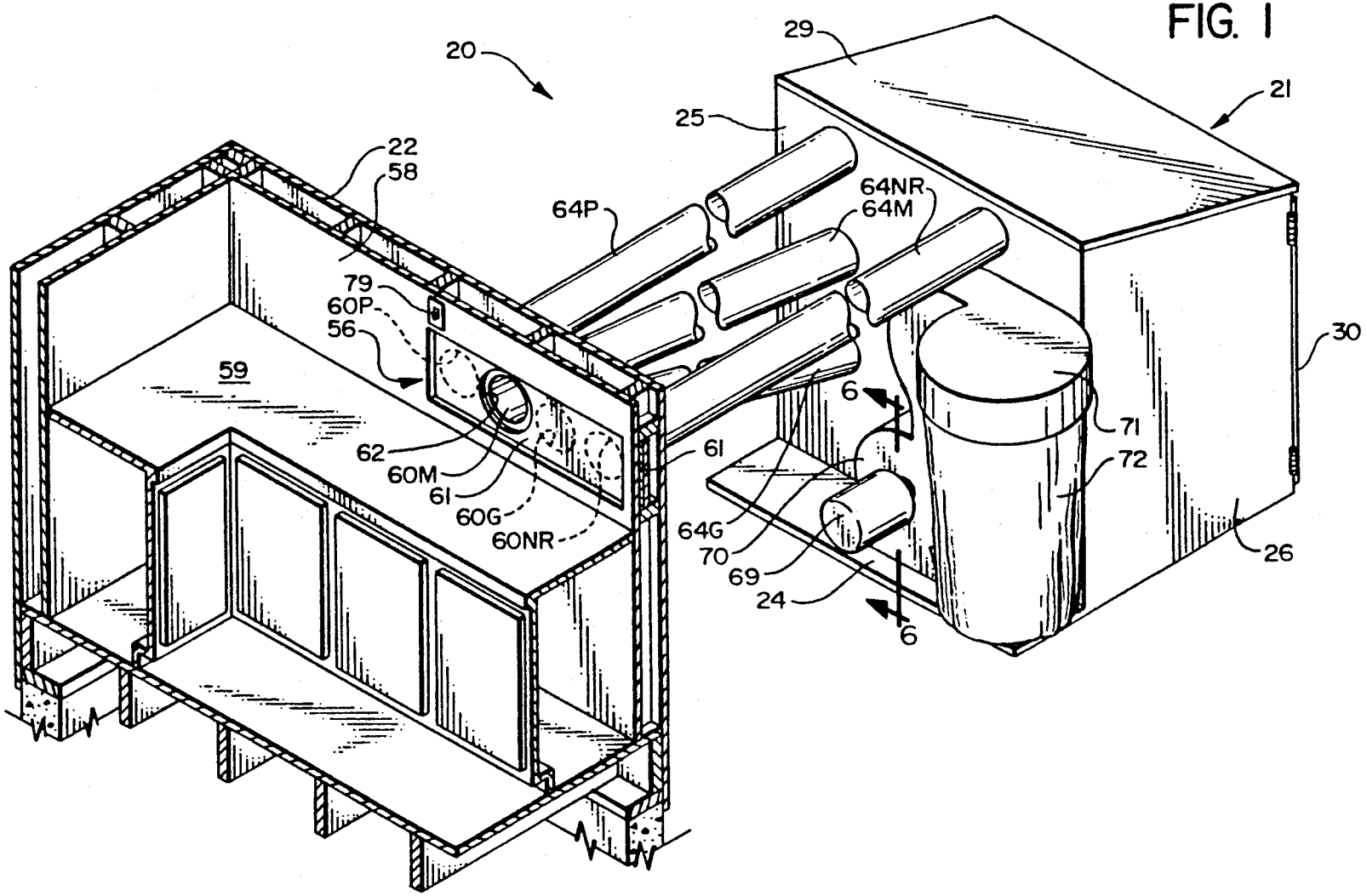
FIG. 1 is a highly diagrammatic, fragmentary, isometric view depicting an exemplary trash disposal system embodying features of the present invention, here illustrating both a remote pickup station and a fragmentary portion of a building structure wherein a plurality of dedicated trash disposal ports have been installed in the wall of a kitchen, utility room or similar room within the structure.

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and/or alternatives falling within the spirit and scope of the invention as expressed in the appended claims.

DETAILED DESCRIPTION

Figure 2:
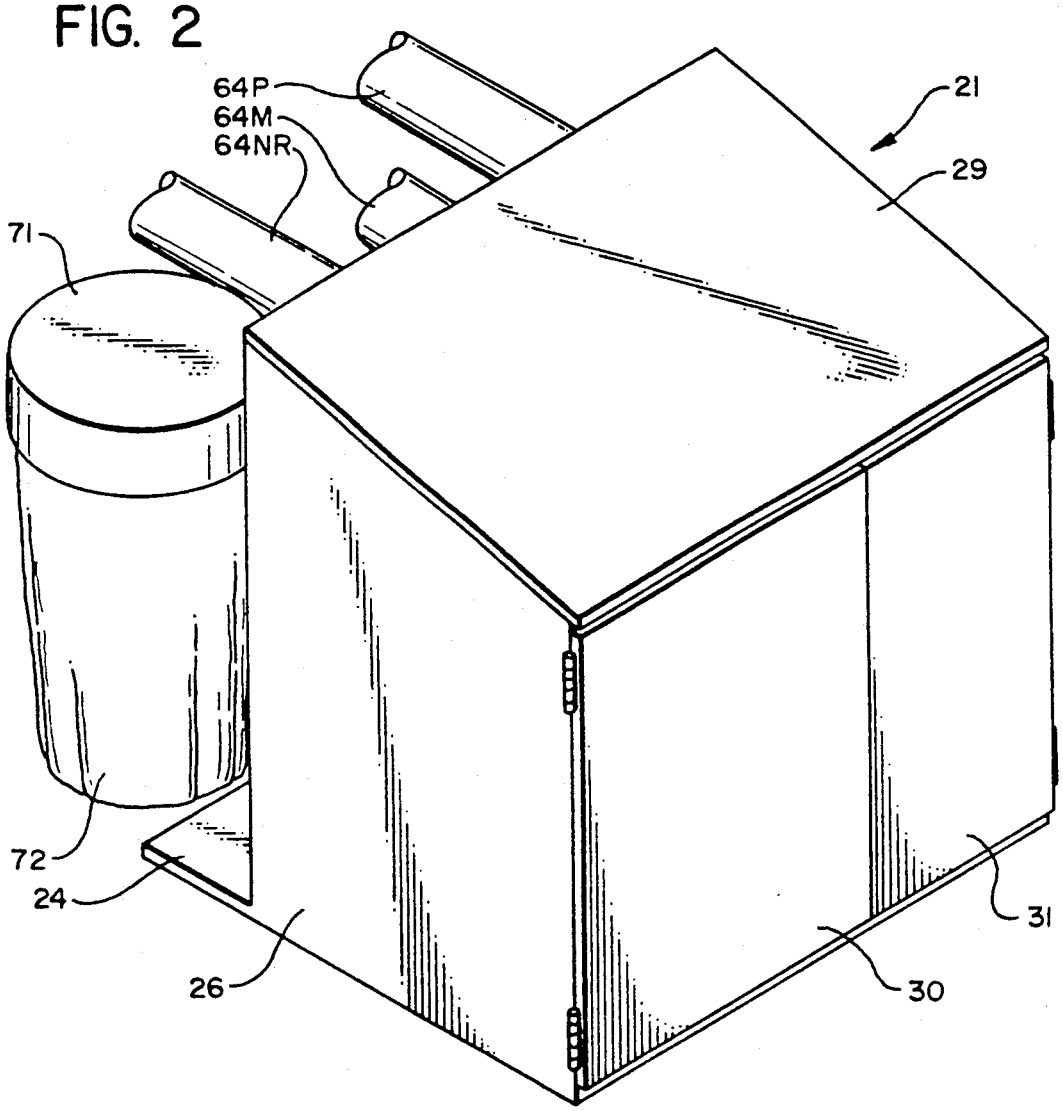
FIG. 2 is a fragmentary isometric view here depicting the housing and closed access doors for the remote trash station shown in FIG. 1.
Figure 3:
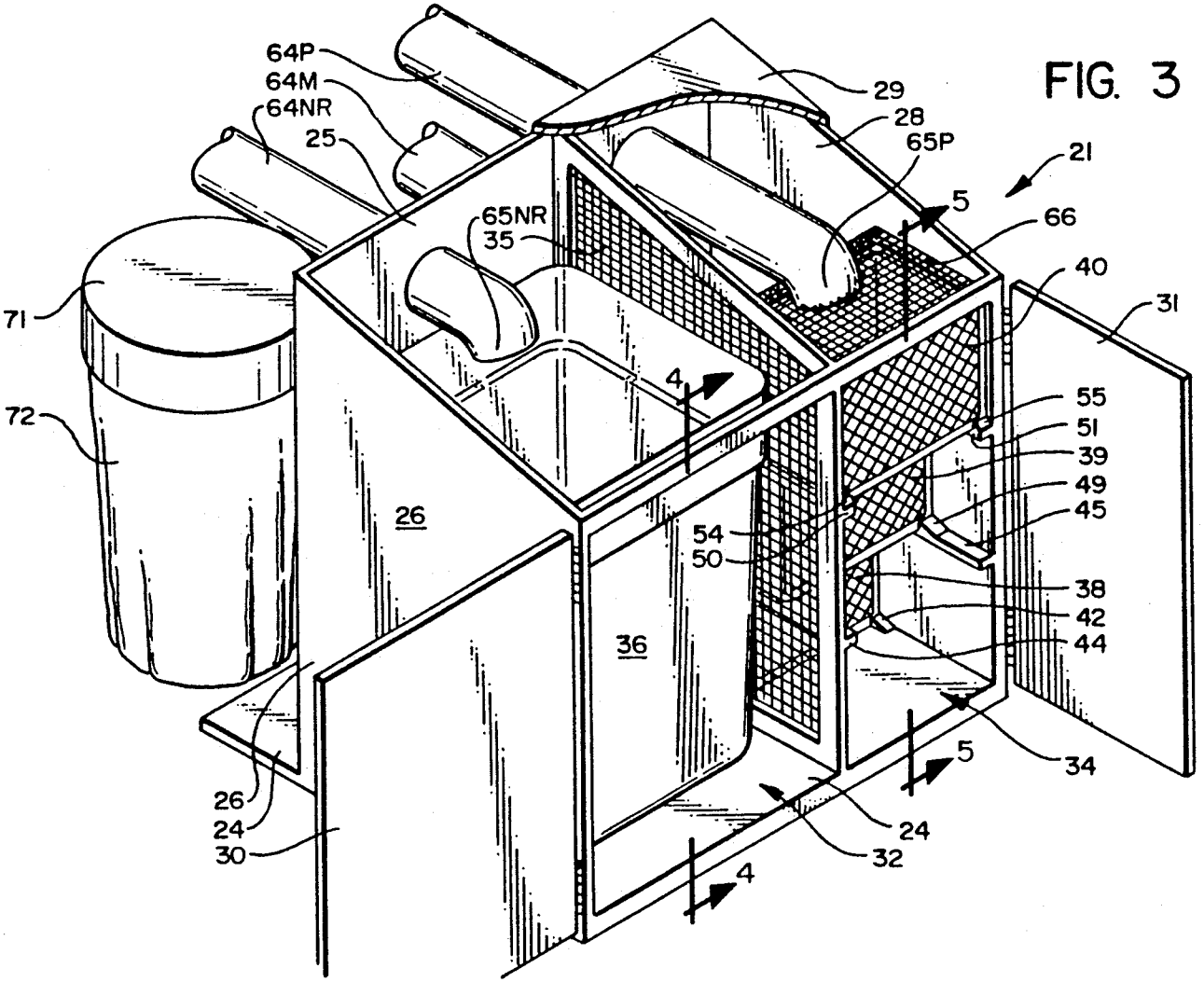
FIG. 3 is a fragmentary isometric view of the remote trash pickup station shown in FIG. 2, here depicting the housing with the access doors open and the roof partially broken away so as to expose interior portions of the housing.

Turning now to the drawings, an exemplary trash disposal system embodying features of the present invention, here generally indicated at 20, has been diagrammatically illustrated in FIG. 1. In the exemplary form of the invention shown in FIGS. 1 and 2, the trash disposal system 20 includes an enclosed trash bin or housing, generally indicated at 21, which is preferably located at any suitable point remote from the building structure 22 where trash is typically generated—such, for example, as: a home, apartment or other residence; a business office, a manufacturing facility; or the like. The illustrative trash housing 21 includes: a base or floor 24; a rear wall 25; opposed parallel sidewalls 26, 28 (sidewall 28 is not visible in FIG. 1 but is visible in FIGS. 3 and 7); a top wall or roof 29; and, as best shown in FIGS. 2 and 3, a pair of access doors 30, 31.

Figure 4:
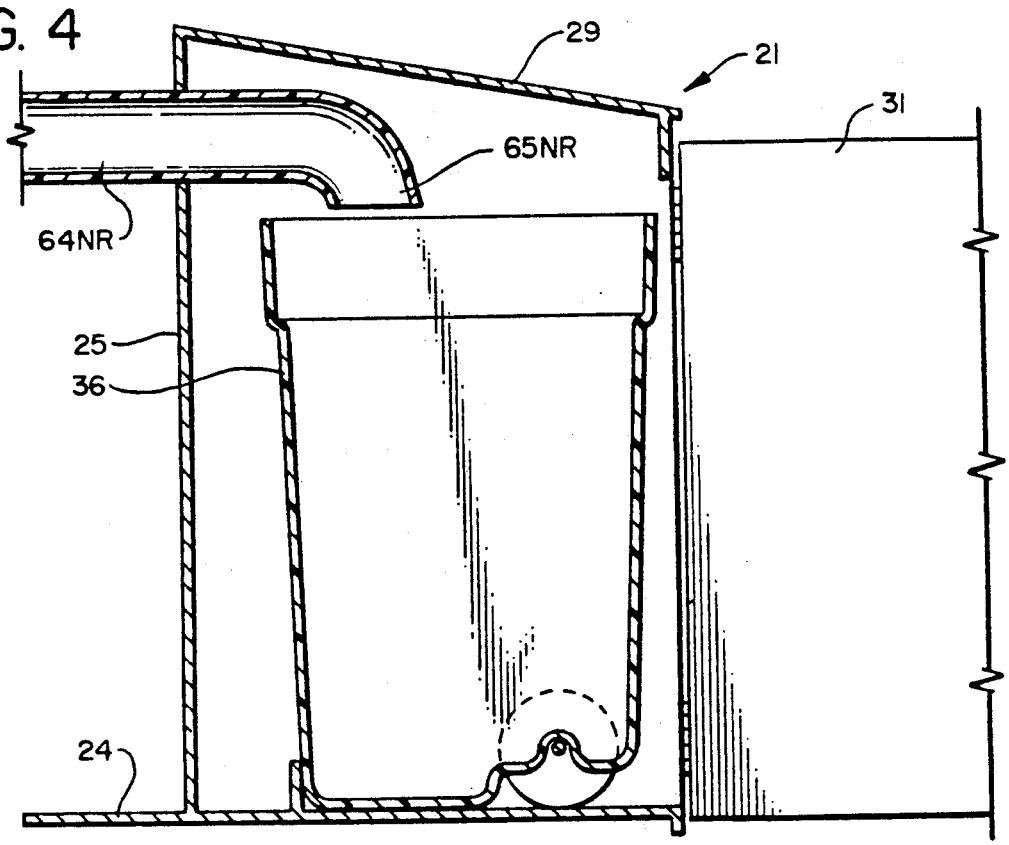
FIG. 4 is a vertical sectional view taken substantially along the line 4—4 in FIG. 3, but with certain parts removed for purposes of clarity, here depicting details of one interior portion of the trash pickup housing within which a single, removable, dedicated trash-receiving receptacle is mounted.
Figure 5:
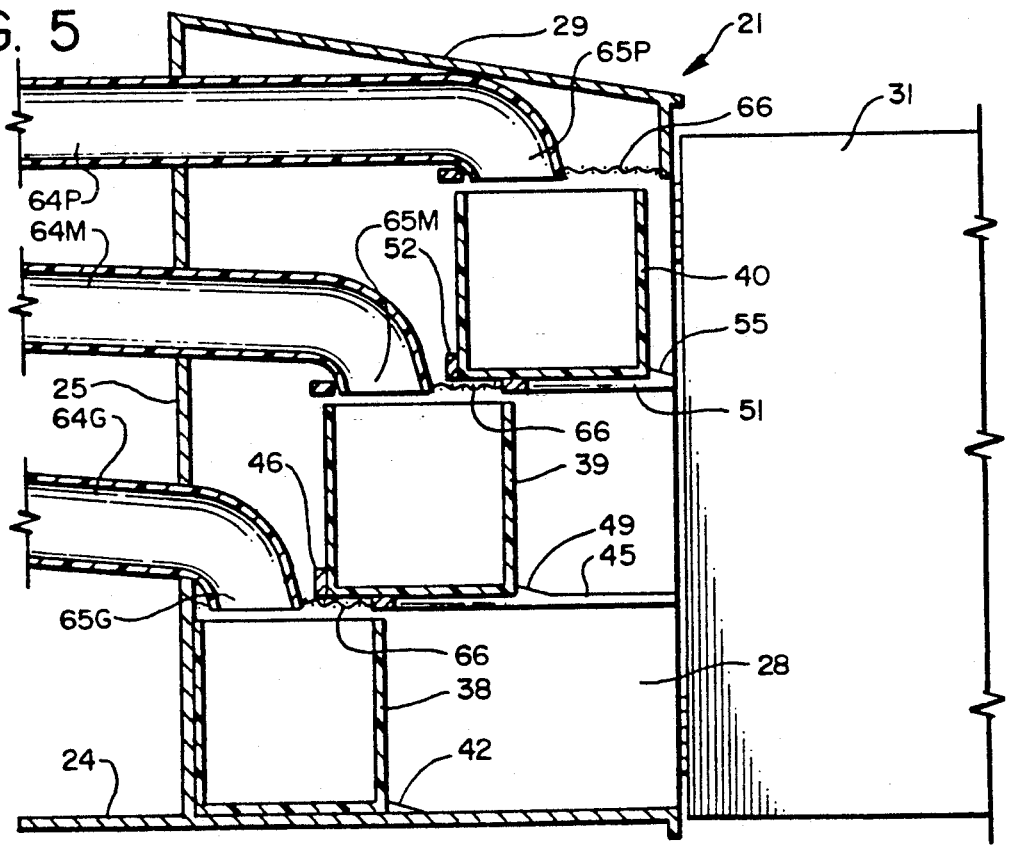
FIG. 5 is a vertical sectional view similar to FIG. 4, but here taken substantially along the line 5—5 in FIG. 3 and illustrating the interior portion of a different region of the trash pickup housing within which three (3) dedicated trash-receiving receptacles are removably mounted.

As best illustrated by reference to FIGS. 3 through 7 conjointly, it will be observed that the illustrative trash housing 21 is internally divided into left and right compartments or sections as viewed in FIG. 3, generally indicated at 32 and 34, by means of a vertical perforate wall or screen 35. In the illustrative system 20, the left compartment 32 serves to house a relatively large, removable trash container or receptacle 36 which is here intended to receive and temporarily store, prior to pickup, non-recyclable trash; whereas the right compartment 34 as viewed in the drawings is designed to receive three (3) trash containers or receptacles 38, 39, 40 dedicated to receive three (3) different categories of recyclable trash, such receptacles being disposed in a vertically spaced, forwardly offset array. To accomplish this, the lowermost receptacle 38 rests on the floor 24 of the trash housing 21 and is positioned in the rear of compartment 34 immediately adjacent the rear wall 25 as best shown in FIGS. 3 and 5. A pair of left and right shim-like blocks 41, 42, best illustrated by reference to FIGS. 3, 5 and 7 conjointly, are mounted on the floor 24, thus serving to fix the lower receptacle 38 in place until such time as one desires to remove the receptacle 38 by lifting it above the blocks 41, 42 and withdrawing it from the housing 21 so as to enable emptying of the recyclable trash contained therein.

The middle receptacle 39 is supported on a pair of left and right supports 44, 45 which are adapted to be mounted on facing surfaces of partition 35 and sidewall 28 just above the level of the upper edge of the bottom receptacle 38. A rear transverse stop 46 (FIG. 5) is provided for insuring that when the middle receptacle 39 is positioned within housing 21 on supports 44, 45, it is generally centrally located between the rear wall 25 and the door 31—i.e., it is forwardly offset with respect to the lower receptacle 38 as best viewed in FIG. 5. Supports 44, 45 are shaped to provide upwardly extending shim-like blocks 48, 49 positioned to removably lock the middle receptacle 39 in place.

In like manner, the upper trash receptacle 40 is supported on a pair of left and right supports 50, 51 which are adapted to be mounted on facing surfaces of partition 35 and sidewall 28 just above the level of the upper edge of the middle trash receptacle 39. A rear transverse stop 52 (FIG. 5) is provided for insuring that when the upper receptacle 40 is positioned within housing 21 on supports 50, 51, it is spaced above, and offset forwardly of, the middle trash receptacle 39—i.e., it is located in close proximity to the door 31 as best shown in FIG. 5. Again, supports 50, 51 are shaped to provide upwardly extending shim-like blocks 54, 55 positioned to removably lock the upper trash receptacle 40 in place.

In carrying out the present invention, it will become apparent to those skilled in the art that the trash receptacles 38, 39 and 40 are dedicated trash receptacles intended to receive specific different types of recyclable trash—for example, the bottom receptacle 38 might be intended to receive glass products and, therefore, might be color coded red or whatever other color is assigned to recyclable glass trash in that particular community. Similarly, the middle trash receptacle 39 might be dedicated to receive metal trash such as food tins, beer cans, soda cans and the like; and, therefore, might be color coded blue or whatever other color is assigned to recyclable metal trash in that particular community. Finally, the top trash receptacle 40 might be dedicated to receive plastic trash products; and, therefore, might be color coded yellow or whatever other color is assigned to that type of recyclable trash in that particular community.

Figure 8A:
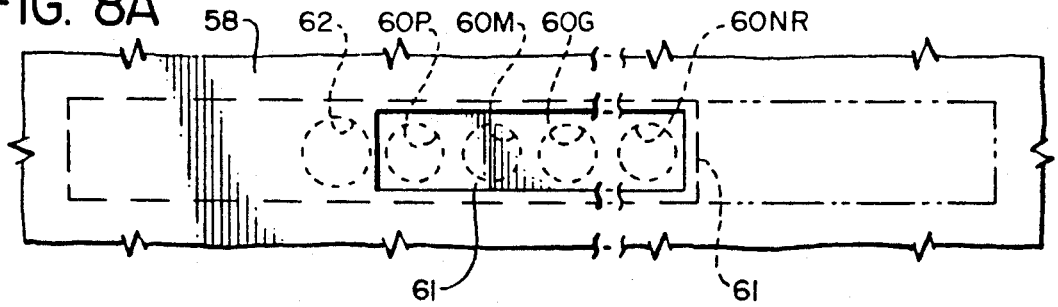
FIGS. 8A through 8E are stop motion front levational views here illustrating movement of a sliding closure member overlying the trash disposal ports in the kitchen, utility room or similar trash disposal station within a building structure and particularly showing the position of the closure member as it is successively moved from left to right as viewed in the drawing from a position wherein all four (4) disposal ports are closed (FIG. 8A) to successive positions wherein the four (4) trash disposal ports are sequentially opened from left to right with FIG. 8C depicting the closure member in the same position as shown in FIG. 1.
Figure 8B:
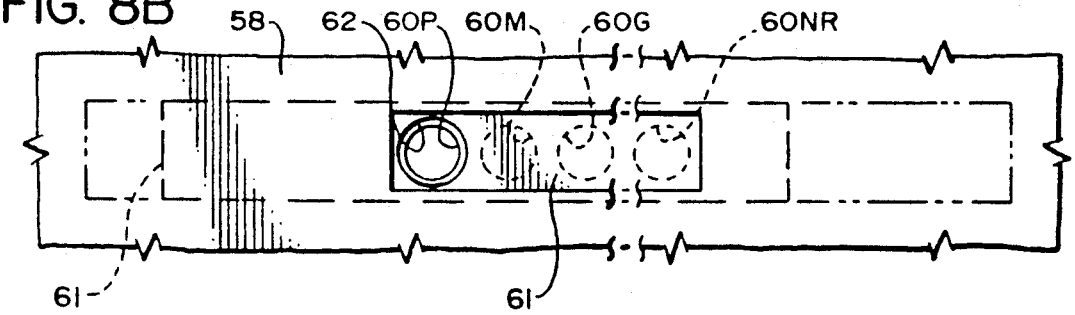

Referring again to FIG. 1, it will be observed that the particular room selected in the building structure 22 for forming the site of a trash disposal station—for example, a utility room, laundry room, garage, or as here indicated, a kitchen—is preferably provided with a trash disposal station such as here generally indicated at 56. Station 56 is preferably mounted in an exterior wall 58 of the building structure 22; and, in the exemplary system here shown, is mounted above the kitchen cabinets 59 or sink (not shown). In the illustrative system, the trash disposal station 56 includes four (4) trash disposal ports 60P (adapted to receive, for example, items of plastic trash), 60M (adapted to receive, for example, items of metal trash), 60G (adapted to receive, for example, items of glass), and 60NR (adapted to receive, for example, items of non-recyclable trash). A laterally shiftable closure member 61 having a single trash discharge port 62 formed therein is mounted in the wall 58 in a position overlying the trash disposal ports 60P, 60M, 60G, 60NR. The arrangement is such that when closure member 61 is shifted fully to the left as shown in FIG. 8A, the discharge port 62 in the closure member 61 is located completely within the wall 58; and, consequently, all of the trash disposal ports 60P, 60M, 60G and 60NR are effectively closed. As the closure member 61 is shifted to the right to the position shown in FIG. 8B, the closure member's discharge port 62 is aligned with and registered with trash disposal port 60P, thereby permitting plastic trash items to be inserted into the trash disposal port 60P which may, if desired, be color coded in the same manner as trash receptacle 40 shown in FIGS. 3 and 5 and as hereinabove described. However, all other trash disposal ports—viz., ports 60M, 60G, 60NR—remain closed.

Figure 8C:
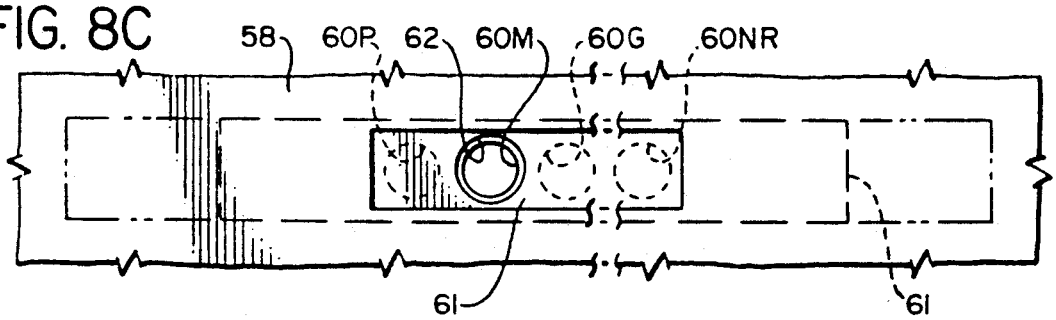
Figure 8D:
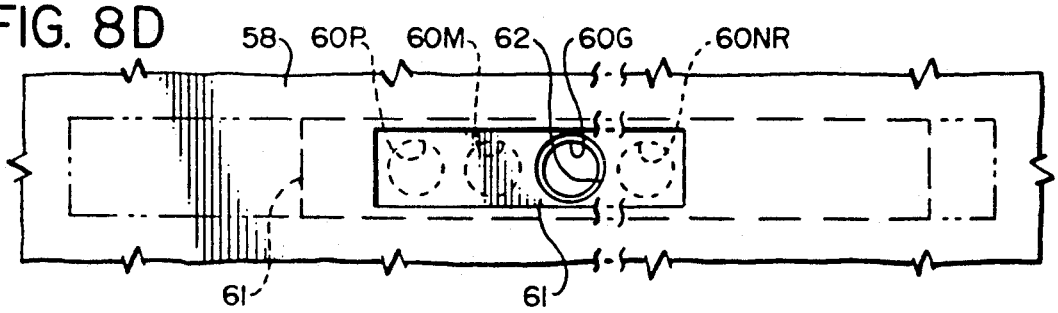
Figure 8E:
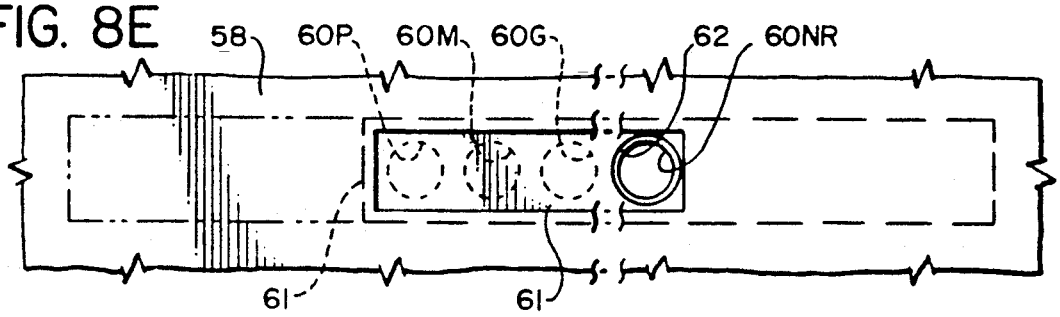

Continued movement of the closure member 61 to the right to the position shown in FIGS. 1 and 8C serves to register the closure member's discharge port 62 with trash disposal port 60M, conditioning the system for disposal of metal trash items. Further movement of the closure member 61 to the right to the position shown in FIG. 8D serves to align discharge port 62 and disposal port 60G, conditioning the system for disposal of glass trash items; while movement to the position shown in FIG. 8E aligns discharge port 62 and disiposal port 60NR, conditioning the system for disposal of items of non-recyclable trash. Movement of the closure member 61 from left-to-right and from right-to-left can be accomplished in any desired manner such, for example, as by manually shifting the closure member. Moreover, each of the trash disposal ports 60M, 60G, and 60NR can be color coded to correspond with the color coding applied to the receptacles 39, 38 and 36 respectively. Alternatively, suitably inscribed labels or name plates (not shown) can be applied to the wall 58 either above or below the trash disposal ports 60P, 60M, 60G, 60NR so as to serve as a visual indicator of which type of trash is to be inserted into each trash disposal port.

In carrying out the present invention, conduit means are provided for interconnecting each trash disposal port 60P, 60M, 60G, 60NR located internally of the building structure 22 to respective different ones of the dedicated trash receptacles 40, 39, 38, 36 located in the remotely located trash housing 21. In the exemplary system shown in FIGS. 1 through 7, four (4) such conduit members 64 are provided—viz., a conduit 64P coupling trash disposal port 60P with the top receptacle 40 in housing 21 dedicated to receive plastic trash items; a conduit 64M coupling trash disposal port 60M with the middle trash receptacle 39 in housing 21 dedicated to receive metal trash items; a conduit 64G coupling trash disposal port 60G with the bottom trash receptacle 38 in housing 21 dedicated to receive glass trash items; and, conduit 64NR coupling trash disposal port 60NR to the large trash receptacle 36 in housing 21 dedicated to receive items of non-recyclable trash. As best shown in FIG. 4, trash conduit 64NR terminates at its outboard end internally of trash housing 21 in a trash disposal chute or spout 65NR located immediately above and directed into the remotely located trash receptacle 36 so that all non-recyclable trash inserted into trash disposal port 60NR (FIG. 1) located internally of the building structure 22 is conveyed directly from the discharge port 60NR to the receptacle 36 where it is temporarily stored until removed from trash housing 21 by authorized sanitary service personnel.

In like fashion, and as best shown in FIG. 5, trash conduits 64P, 64M, 64G respectively terminate in downturned disposal spouts or chutes 65P, 65M, 65G located immediately above respective different ones of the trash receptacles 40, 39, 38 which, as previously described, are dedicated to receive and temporarily store recyclable plastic, metal and glass trash items. To insure that trash delivered to any one of receptacles 38, 39, 40 is not blown or sucked out of the receptacle, suitable perforate screens 66 are mounted within compartment 34 immediately above the respective receptacle and surround the discharge spouts 65P, 65M, 65G on the outer end of the conduits 64P, 64M, 64G with such screens being secured to, and spaning the space between, sidewall 38 and partition 35 as best shown by reference to FIGS. 3 and 5 conjointly.

Figure 6:
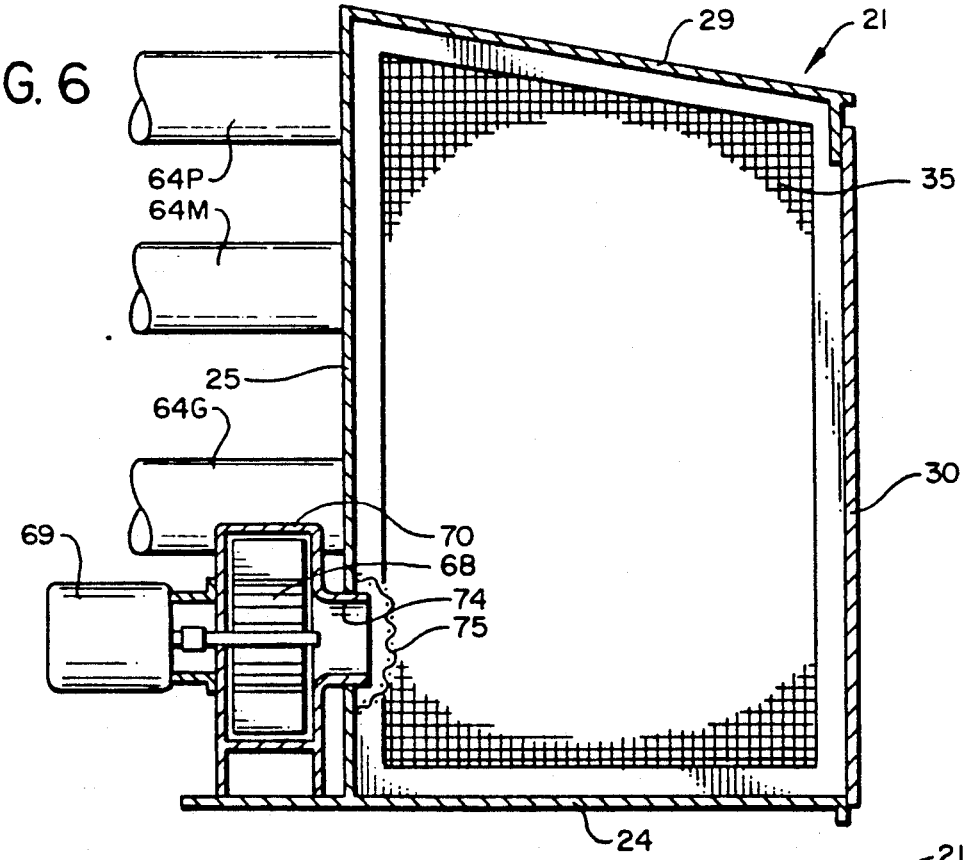
FIG. 6 is a vertical sectional view similar to FIG. 4, but taken substantially along the line 6—6 in FIG. 1, with the trash receptacles removed, here illustrating details of the exemplary vacuum generation system.
Figure 7:
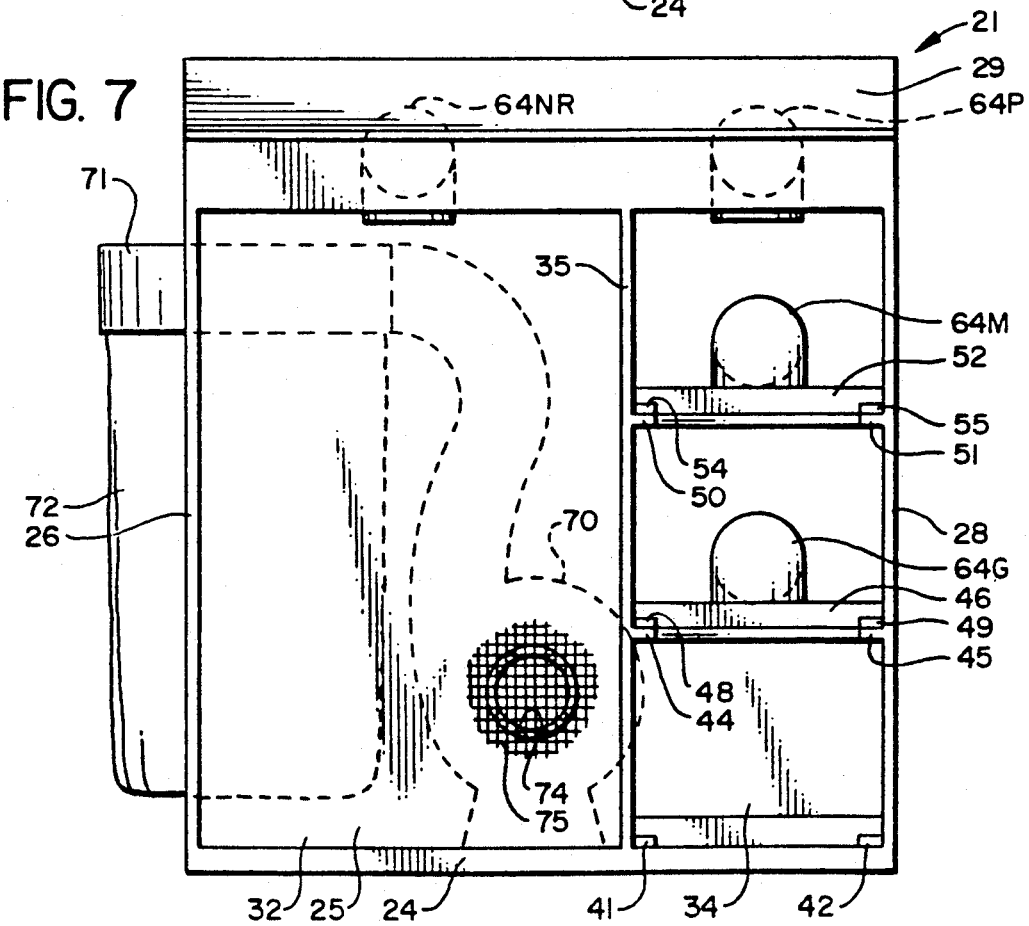
FIG. 7 is a front elevational view of the trash pickup housing depicted in FIGS. 2 through 6, here illustrating the housing with the doors and trash receptacles removed for of clarity.

Finally, the exemplary trash disposal system 20 is provided with suitable means for drawing a vacuum internally of housing 21 and, therefore, of conduits 64P, 64M, 64G and 64NR so as to automatically shift discarded items of trash from the trash disposal station 56 (FIG. 1) located within the building structure 22 to the particular dedicated trash receptacle 36, 38, 39, 40 within the remotely located trash housing 21 to which such trash items are to be conveyed. To accomplish this, and as best illustrated in FIGS. 1, 6 and 7, it will be noted that a centrifugal blower 68 driven by a motor 69 is mounted in a housing 70 terminating at its upper end in a rigid cover 71 to which is securely attached a large fabric dust bag 72. Blower 68 communicates with the interior of trash housing 21 via an axially-extending inlet conduit 74 passing through the rear wall 25 of housing 21. A suitable perforate screen 75 is preferably mounted about the inboard end of conduit 74 so as to prevent trash items from being carried through the blower 68 to bag 72. Thus, the arrangement is such that when the motor 69 is turned "ON", air is removed from the interior of trash housing 21, creating a partial, but significant, vacuum therein; with the removed air passing outwardly through the housing 71 into dust bag 72 and from there through the air-permeable wall of the fabric bag 72 to the surrounding atmosphere. It has been found that the creation of a partial, but significant, vacuum within housing 21 serves to draw the doors 30, 31 into a tightly clamped, sealed position; and, if desired, suitable deformable seals (not shown) can be provided about the peripheral edges of the doors 30, 31 and between the housing wall and the doors so as to positively exclude air from entering the interior of housing 21. As air is withdrawn from housing 21, a vacuum is created therein, not only in both the left and right compartments 32, 34 of the housing 21, but also in the trash conduit 64P, 64M, 64G, 64NR. Consequently, when the closure member 61 is shifted laterally from the position shown in FIG. 8A where all trash disposal ports 60P, 60M, 60G, 60NR are closed to one of the positions shown in FIGS. 8 through 8E where one, and only one, of the trash disposal ports is aligned with the port 62 in closure member 61, the vacuum produced at that port serves to rapidly convey the discarded item of trash directly to the one of the remotely located trash receptacles 36, 38, 39, 40 which is dedicated to receive that particular item of trash.

Those skilled in the art will, of course, appreciate that the magnitude of the vacuum created will be a function of the size of the trash housing 21 and conduits 64P-64NR, the distance of the remotely located trash housing 21 from the trash disposal station 56 within the building structure 22, and the size, design and power of the blower 68 and motor 69. However, these are all design variables which can be selected by persons skilled in, for example, the central vacuum system art to effectively produce the desired end result. Indeed, with a prototype system wherein the remote trash housing 21 was located approximately one hundred feet (100') from the internal trash disposal station 56 and wherein the blower/motor combination 68/69 comprized a Grizzley motor and Model G1030 dust collector—i.e., a 3 HP motor and a 15" impeller operating at 3,450 R.P.M. to produce an air suction capacity of 1,883 c.f.m. at a static pressure of 5.83" using 6" Dia. ducts and duct openings—it was found that sufficient vacuum was created that small trash items such as soda cans thrown at the open trash discharge port 60M—as contrasted with being manually inserted therein—were effectively and virtually instantaneously conveyed to the proper remotely located dedicated trash receptacle 39.

It will be further understood that while the exemplary trash disposal system 20 hereinabove described employs four (4) dedicated trash disposal ports, four (4) dedicated remote trash receptacles, and four (4) communicating conduits, the invention is not limited to combinations of four (4) of such components but, rather, can be effectively used with two (2), three (3), four (4), five (5) or more categories of trash items. Nevertheless, it is also well within the scope of the invention to employ a single conduit interconnecting all of the multiple internal trash disposal ports with all of the remotely located receptacles provided only that suitable conventional valves (not shown) are provided adjacent the receptacles which are interconnected with, and automatically opened one at a time, when the closure discharge port 62 in closure member 61 is aligned and registered with a particular one of the multiple internal trash disposal ports 60P, 60M, 60G, 60NR.

Figure 9A:
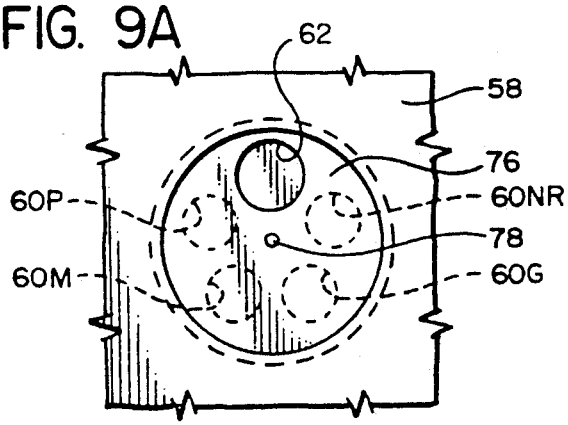
FIGS. 9A and 9B are fragmentary front elevational views here depicting a modified type of trash disposal port closure member also embodying features of the present invention.
Figure 9B:
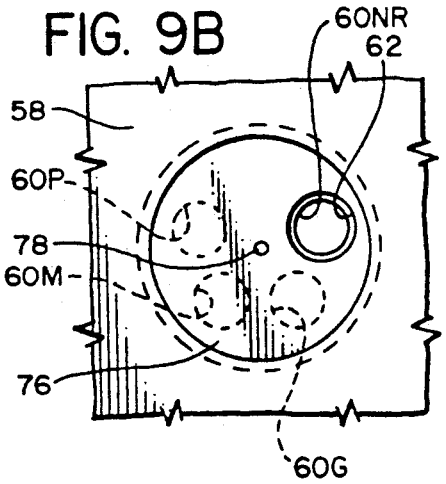

Those skilled in the art will further appreciate that the particular arrangement of the internally located trash disposal ports depicted in FIGS. 1 and 8A through 8E is not critical to the present invention. Thus, the trash disposal ports can be arrayed in a linear array as shown in FIGS. 1 and 8A through 8E; they can be oriented in a circular array as shown in FIGS. 9A and 9B employing a circular closure member 76 rotatable about its axis 78 to align a discharge port 62 therein with any one, or none, of the internal trash disposal ports 60P, 60M, 60G, 60NR; or, in virtually any other desired configuration. Moreover, a wall-mounted switch 79 (FIG. 1) can be provided for manually turning the motor 69 "ON" and "OFF"; or, if desired, suitable switches (not shown) can be provided within the wall 58 which are actuated by movement of the closure member 61 or 76 to turn the motor 69 "ON" and "OFF".

Figure 10:
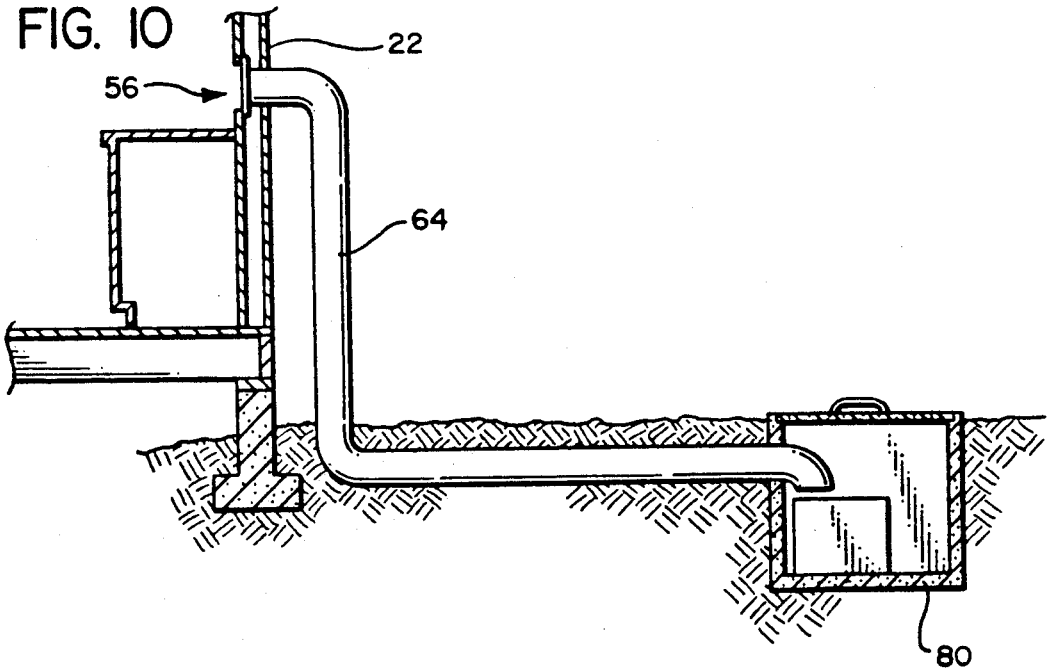
FIG. 10 is a fragmentary side elevational view here illustrating a trash disposal system embodying features of the present invention wherein the conduit(s) interconnecting the trash disposal ports within the interior of the building structure to the remotely located trash pickup station is(are) connected to an underground trash pickup station.

Referring to FIG. 10, it will be noted that the remotely located trash housing, here designated at 80, can be located below ground with the trash conduit(s) 64 also extending below ground between the building structure 22 and the trash housing 80.

Figure 11:
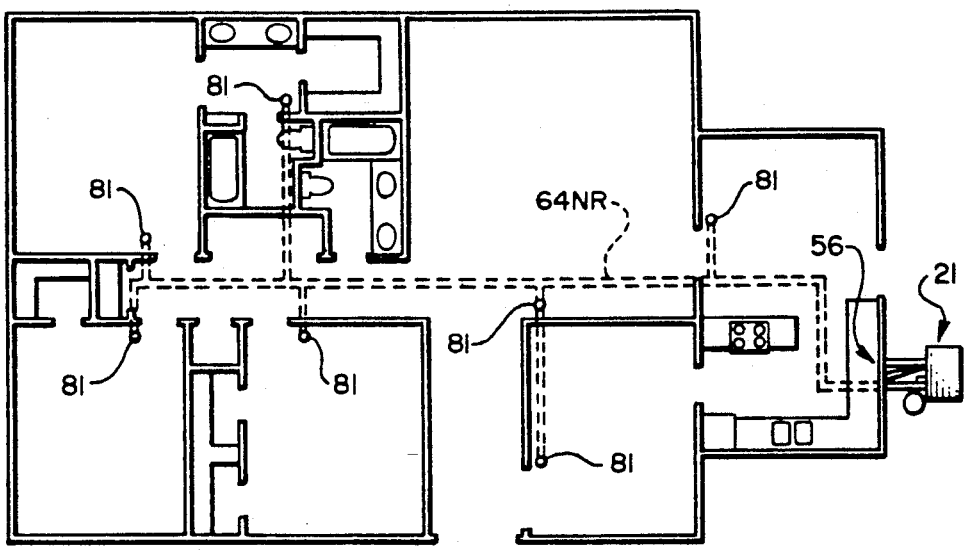
FIG. 11 is a highly diagrammatic top plan view here illustrating a trash disposal system embodying features of the present invention as it might be incorporated with a conventional central vacuum system for use in a residential structure; and, FIG. 12 is a fragmentary, highly diagrammatic, elevational view here depicting how a trash inlet port for use with the present trash disposal system can be modified for use in catching rodents of the type commonly found in areas where trash is generated.

Moreover, it is also within the scope of the present invention to incorporate the automatic trash disposal system 20 with an otherwise completely conventional central vacuum system. Thus, referring to FIG. 11, it will be noted that the exemplary remotely located trash housing 21 can have vacuum conduit 64NR (or any other conduit for that matter) also coupled to various inlet ports 81 located in the different rooms of the structure 22. Such inlet ports 81 can be of completely conventional construction such that when opened and the wand of a house vacuum (not shown) is inserted therein, the motor 69 is turned "ON" even though all of the interior trash disposal ports 60P, 60M, 60G, 60NR at the trash disposal station 56 (FIG. 1) remain closed.

Figure 12:
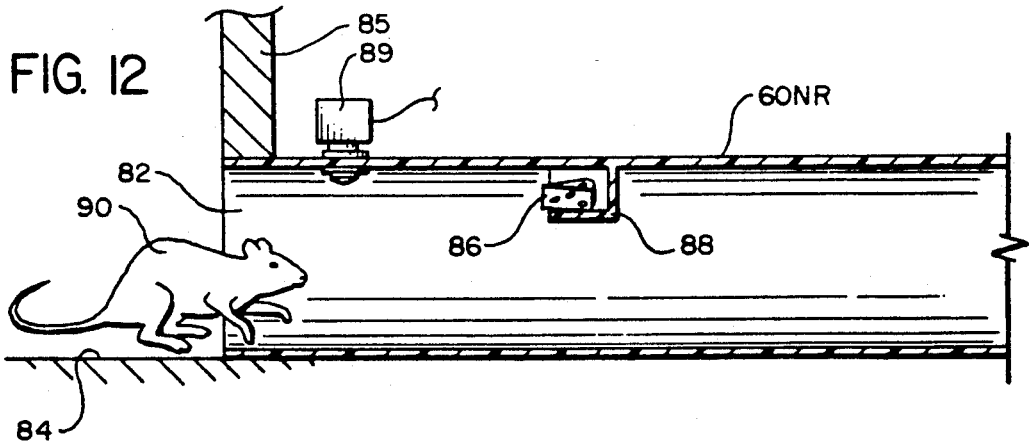

Finally, the present invention also provides an effective system for controlling mice and similar unwanted rodents which commonly infest areas where trash is generated. Thus, referring to FIG. 12, it will be noted that the conduit 64NR here terminates in an inlet port 82 located in the baseboard of the structure adjacent the floor 84 and an adjacent wall 85. Cheese or other appropriate bait 86 can be mounted in a support bracket 88 affixed to the interior of conduit 64NR several inches inboard of the inlet port 82. Any conventional heat or motion sensor 89 can be provided intermediate the inlet port 82 and the bait 86 for sensing the presence of a rodent 90 attracted by the bait 86. Upon sensing the presence of a rodent 90, the heat or motion sensor 89 serves to turn the motor 69 (FIG. 1) "ON", generating a vacuum in conduit 64NR and rapidly delivering the rodent 90 to the relatively large receptacle 36 (FIGS. 3 and 4) in the remotely located trash housing 21, which receptacle would preferably have a smooth interior surface and a height sufficient to prevent escape of the rodent.

Thus, those persons skilled in the art will appreciate that there has hereinabove been described a simple, yet highly effective, automatic trash disposal system which readily permits users to effectively segregate recyclable trash items from non-recyclable trash items instantaneously at the time of generation, and to automatically transfer those items from the interior of the building structure 22 where the trash items are generated to a remote exterior location where they are stored in a particular one of a plurality of dedicated trash containers for subsequent pickup. The invention eliminates the need to store trash temporarily within the building structure, thus minimizing noxious odors and the accumulation of flies and the like; while, at the same time eliminating the need for individuals to sort through trash containers to segregate recyclable trash items from non-recyclable trash items. Additionally, the invention eliminates the need to physically carry trash from the structure to a remote pickup location, thereby eliminating the need to go outdoors during inclemate weather and/or in the dark.

I claim:

1. Trash handling apparatus for transferring differing items of trash by category from a structure containing a place of trash generation to a remotely located trash pickup point so as to facilitate at least one of disposal and recycling thereof; said apparatus comprising, in combination:

a) a structure containing a place of trash generation;

b) an enclosed trash housing disposed at or adjacent a trash pickup point and remote from said structure, said housing including:

i) normally closed, externally openable, first door defining means; and ii) a plurality of dedicated internal locations for removably housing respective ones of a plurality of trash containers each dedicated to receive a different category of trash;

c) a plurality of trash containers removably positioned within respective different ones of said plurality of dedicated internal locations within said trash housing;

d) at least one trash disposal point located remote to said housing and internally of said structure, said trash disposal point including:

iii) a plurality of trash disposal ports respectively dedicated to receive specific ones of different categories of trash; and, iv) second door-defining means movable across the face of said plurality of trash disposal ports for permitting opening of any selected one of said disposal ports and closure of the balance of said disposal ports;

e) vacuum-tight conduit defining means extending between said coupling said plurality of disposal ports and said plurality of designated internal locations in said enclosed trash housing;

f) means for drawing a vacuum in said enclosed trash housing; and, g) means for selectively activating and deactivating said vacuum drawing means so that when a user desires to discard a particular item of trash, said vacuum discharge means can be activated to create a vacuum in said housing and in said conduit defining means so that upon shifting of said second door-defining means to open a particular one of said plurality of disposal ports dedicated to receive the particular trash item to be discarded, the user can insert that trash item into the now open dedicated trash disposal port, thereby causing such trash item to be vacuum conveyed from said open one of said plurality of disposal ports through said conduit defining means to the respective one of said plurality of dedicated internal locations in said trash housing for discharge into the proper one of said plurality of trash containers whereby said trash is sorted by category so as to permit ease of at least one of recycling and disposal thereof, as required.

2. Trash handling apparatus as set forth in claim 1 wherein said vacuum-tight conduit defining means comprises a plurality of conduits open at their opposite ends and extending between and coupling respective ones of said plurality of designated internal locations in said enclosed trash housing.

3. Trash handling apparatus as set forth in claim 1 wherein said dedicated trash containers, internal locations and disposal ports are visually coded to signify the category of trash to be delivered to each of said containers.

4. Trash handling apparatus as set forth in claim 2 wherein said dedicated trash containers, internal locations and disposal ports are color coded to signify the category of trash to be delivered to each of said containers.

5. Trash handling apparatus as set forth in claim 1 wherein said conduit-defining means extending from said trash disposal point located internally of said structure to said enclosed trash housing located externally of and remote from said structure are buried underground intermediate said structure and said housing.

6. Trash handling apparatus as set forth in claim 2 wherein said plurality of conduits are buried underground intermediate said structure and said housing.

7. Trash handling apparatus as set forth in claim 1 wherein said means for selectively activating and deactivating said vacuum drawing means includes a power source and means coupling said power source to said vacuum drawing means, said coupling means including a normally open switch which, upon closure, completes an energizing circuit from said power source to activate said vacuum drawing means.

8. Trash handling apparatus as set forth in claim 7 wherein said switch is adapted to be manually actuated by the user.

9. Trash handling apparatus as set forth in claim 7 wherein said switch is actuated by movement of said second door defining means.

10. Trash handling apparatus as set forth in claim 7 further including an additional conduit extending from said enclosed housing into said structure with said additional conduit terminating in a plurality of normally closed central vacuum system inlet ports spaced throughout said structure, said plurality of normally closed central vacuum system inlet ports including switch means coupled to said power source and said means for drawing a vacuum in said housing and operable to complete said energizing circuit from said power source to said vacuum drawing means to activate said vacuum drawing means whenever one of said central vacuum system inlet ports is opened and a portable vacuum hose is inserted therein.

11. Trash handling apparatus as set forth in claim 7 further including an additional conduit extending from said enclosed housing into said structure with said additional conduit terminating in at least one normally open rodent inlet port situated in one or more locations within said structure likely to be rodent infested and readily accessible to rodents; means for supporting rodent enticing bait within said additional conduit spaced inwardly from each said rodent inlet port; and, sensing means interposed between each said rodent inlet port and said support means for rodent enticing bait for detecting the presence of a rodent entering said rodent inlet port and for generating an output signal indicative of the presence of a rodent for directly coupling said power source to said vacuum drawing means to activate the latter and cause the rodent to be vacuum conveyed through said additional conduit and to be discarded into one of said remotely located trash containers.

12. Trash handling apparatus as set forth in claim 10 further including a second conduit extending from said enclosed housing into said structure with said second additional conduit terminating in at least one normally open rodent inlet port situated in one or more locations within said structure likely to be rodent infested and readily accessible to rodents; means for supporting rodent enticing bait within said second additional conduit spaced inwardly from each said rodent inlet port; and, sensing means interposed between each said rodent inlet port and said support means for rodent enticing bait for detecting the presence of a rodent entering said rodent inlet port and for generating an output signal indicative of the presence of a rodent for directly coupling said power source to said vacuum drawing means to activate the latter and cause the rodent to be vacuum conveyed through said second additional conduit and to be discarded into one of said remotely located trash containers.

13. The method of disposing of trash falling into designated ones of a plurality of different categories at least certain of which are recyclable, said method comprising the steps of:

a) positioning an enclosed housing having a normally closed, externally openable, door formed therein at a location remote from the point(s) where trash is generated and generally proximate to a trash pick-up point;

b) establishing a plurality of discrete, dedicated, internal locations within the enclosed housing with each such location dedicated to receive and hold for subsequent pickup a particular different one of a plurality of different categories of trash;

c) positioning a plurality of removable dedicated trash containers in the plurality of discrete, dedicated, internal locations in the housing with each such trash container dedicated to receive a particular one of a plurality of different categories of trash;

d) creating at least one trash disposal point having a plurality of adjacent, dedicated, normally closed trash disposal ports within a structure where trash is generated;

e) coupling the plurality of adjacent, dedicated, normally closed trash disposal ports to respective different ones of the plurality of dedicated trash containers in the remotely located enclosed housing;

f) coupling a normally inactive vacuum source to the remotely located enclosed housing; and, g) providing a user-controlled, switch-actuated, power source for activating the vacuum source so as to draw a vacuum in the enclosed housing and the plurality of conduits when the user opens one of the adjacent dedicated, normally closed trash disposal ports within the structure where trash is generated so as to permit the user to insert any given particular one of different categories of trash in the particular open one of the dedicated trash disposal ports and causing vacuum conveyance of the particular items of trash inserted into such opened disposal port into the proper one of the plurality of dedicated trash containers removably positioned within the enclosed housing for subsequent pickup and either disposal or recycling, as required.

14. The method as set forth in claim 13 wherein the user-controlled, switch-actuated power source includes a manually operable switch adjacent the trash disposal point.

15. The method as set forth in claim 14 wherein the switch is closed in response to opening of one of the normally closed trash disposal ports.

16. The method as set forth in claim 13 further including the step of: coupling one of the plurality of trash containers in the enclosed housing to a vacuum-tight, open-ended conduit extending from such trash container to and through the structure with such conduit forming part of a central vacuum system and terminating in a plurality of normally closed central vacuum system inlet ports each including a switch for completing an energizing circuit to power the normally inactive vacuum source when a normally closed central vacuum system inlet port is opened and a portable vacuum hose is inserted therein.

17. The method as set forth in claim 13 further including the steps of: coupling one of the plurality of trash containers in the enclosed housing to a vacuum-tight, open-ended conduit extending from such trash container to and through the structure with such conduit terminating in at least one open rodent inlet port formed in the structure in one or more regions thereof prone to rodent infestation; positioning a rodent enticing bait within the normally open conduit; and, providing a sensor intermediate the rodent inlet port and the rodent enticing bait for detecting the presence of a rodent entering the rodent inlet port and for producing an output signal upon sensing the presence of a rodent and for coupling the switch-actuated power source to the vacuum source for energizing the latter and causing the rodent to be vacuum conveyed through the conduit and discharged into a remotely located trash container disposed within the enclosed trash housing.

18. The method as set forth in claim 16 further including the steps of: coupling one of the plurality of trash containers in the enclosed housing to a vacuum-tight, open-ended conduit extending from such trash container to and through the structure with such conduit terminating in at least one open rodent inlet port formed in the structure in one or more regions thereof prone to rodent infestation; positioning a rodent enticing bait within the normally open conduit; and, providing a sensor intermediate the rodent inlet port and the rodent enticing bait for detecting the presence of a rodent entering the rodent inlet port and for producing an output signal upon sensing the presence of a rodent and for coupling the switch-actuated power source to the vacuum source for energizing the latter and causing the rodent to be vacuum conveyed through the conduit and discharged into a remotely located trash container disposed within the enclosed trash housing.

* * * * *